United States Patent [19]

Rohmann

[11] Patent Number: 4,869,370

[45] Date of Patent: Sep. 26, 1989

[54] RECEPTACLE FOR THIXOTROPIC MATERIALS

[75] Inventor: Thomas G. Rohmann, Glendale, N.Y.

[73] Assignee: Colgate-Palmolive Company, New York, N.Y.

[21] Appl. No.: 808,077

[22] Filed: Dec. 12, 1985

[51] Int. Cl.[4] ..... B65D 23/04

[52] U.S. Cl. ..... 206/527; 215/1 C; 215/DIG. 8; 366/219

[58] Field of Search ..... 206/216, 219, 527; 215/1 C, 1 R, DIG. 8; 366/53, 129, 130, 219, 220

[56] References Cited

U.S. PATENT DOCUMENTS

| | | | |
|---|---|---|---|
| 1,721,796 | 7/1929 | Taylor | 366/220 |
| 1,765,129 | 6/1930 | Cooke | 366/130 |
| 4,003,555 | 1/1977 | Swartz | 366/130 |
| 4,482,047 | 11/1984 | Ackermann et al. | 206/219 |

*Primary Examiner*—Jimmy G. Foster

*Attorney, Agent, or Firm*—Emrich & Dithmar

[57] ABSTRACT

A receptacle for retaining a material comprising, a bottle having a flat base for placement of the bottle on a support surface, and sidewalls defining a chamber increasing in inner dimensions from the base toward an upper location of the bottle, with the portion of the sidewalls of increasing dimension including at least half of the total size of the chamber. The receptacle has a thixotropic material received in the chamber.

8 Claims, 1 Drawing Sheet

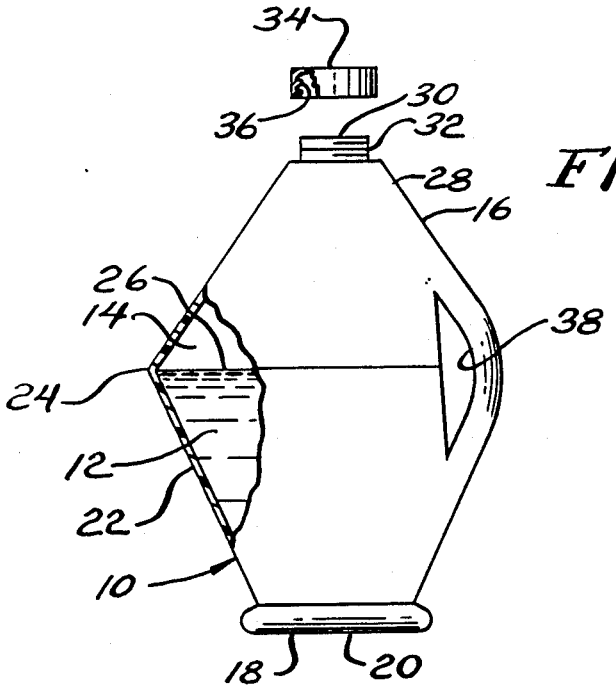
FIG. 1
FIG. 2
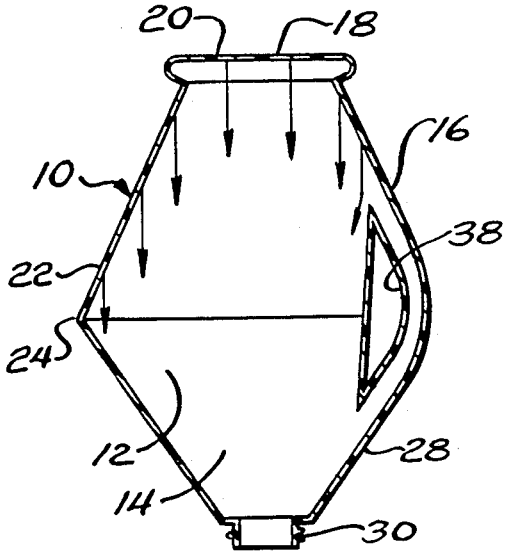
FIG. 3
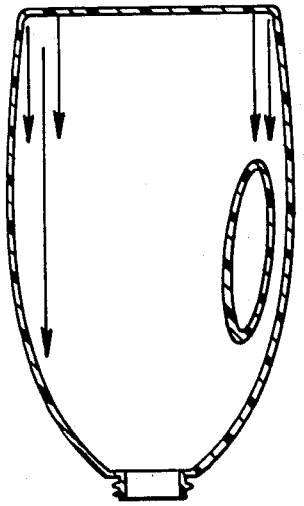
PRIOR ART

RECEPTACLE FOR THIXOTROPIC MATERIALS

BACKGROUND OF THE INVENTION

The present invention relates to receptacles for retaining a material.

Receptacles of various shape and size are known for retaining various materials. However, special consideration must be given to receptacles for retaining a thixotropic material due to viscosity. Thixotropy may be defined as the property of certain gels which liquefy when subjected to vibratory forces, such as shaking, and then solidify again when left standing. Prior receptacles have not been totally adequate for thixotropic materials, due to the shape of the receptacle walls which obstruct proper liquefying and dispensing of the materials from the receptacle.

SUMMARY OF THE INVENTION

A principal feature of the present invention is the provision of an improved receptacle for retaining a thixotropic material.

The receptacle of the present invention comprises a bottle having a flat base for placement of the bottle on a support surface, and sidewalls defining a chamber increasing in inner dimensions from the base toward an upper location of the bottle. The bottle has a portion of the sidewalls of increasing dimension including at least half of the total size of the chamber. The receptacle has a thixotropic material received in the A feature of the present invention is that when the bottle is inverted, the material falls off the bottle sidewalls onto itself.

Another feature of the invention is that when the material falls after the bottle has been inverted, it will be subjected to enough shear stress to overcome its thixotropic yield point.

Yet another feature of the invention is that once the yield point is broken the material will express liquid properties making it easier to shake.

Further features will become more fully apparent in the following description of the embodiments of this invention and from the appended claims.

DESCRIPTION OF THE DRAWINGS

In the drawings:

FIG. 1 is an elevational view, taken partly in section, of a receptacle of the present invention;

FIG. 2 is a sectional view of the receptacle of FIG. 1 with the receptacle in an inverted position; and FIG. 3 is a sectional view of a receptacle of conventional structure.

DESCRIPTION OF THE PREFERRED EMBODIMENTS

Referring now to FIG. 1, there is shown a receptacle generally designated 10 for retaining a thixotropic material 12. The receptacle 10 comprises a bottle 16 having a chamber 14 and a planar bottom wall 18 defining a flat base 20 for placement of the bottle 16 on a support surface S which is shown as being The bottle 16 has sidewalls 22 which are tapered outwardly from the base 20 toward an upper location 24 of the sidewalls 22, such that the sidewalls 22 define a lower portion of the chamber 14 increasing in inner dimensions toward the upper location 24 of the bottle 16 which is a full line 26 for the thixotropic material 12. In a preferred form, the lower portion of the sidewalls are straight throughout a substantial portion, and are disposed at an acute angle defined between the sidewalls and the planar bottom wall 18 or the planar surface S on which the base 20 is disposed. In a suitable form, the acute angle may be approximately 65 degrees, such that the lower portion of the sidewalls are steeply sloped from the base 20 to the upper location 24. The lower portion of the sidewalls 22 which define an increasing dimension for the chamber 14 includes at least half of the total size of the chamber 14.

In a preferred form, the bottle 16 has an upper portion 28 which tapers inwardly from the upper location 24 to a top 30 of the bottle 16, such that the dimensions of the chamber 14 decreases in size from the top the upper location 24 to the top 30 of the bottle 16.

The top 30 of the bottle 16 comprising an annular flange may have outer circumferential threads 32, as shown. The receptacle 10 may have a cap 34 with threads 36, such that the cap 34 may be secured to the top 30 in order to close the chamber 14.

The bottle 16 may have a hollow handle 38 adjacent a mid-portion of the bottle 16 in order to facilitate handling of the bottle 16.

Thus, in accordance with the present invention, the bottle 16 increases in size or width from the bottom wall 18 to an upper location 24 comprising the full line 26 of the bottle 16. The structure of the bottle 16 permits the thixotropic material 12 to fall off the lower portion of the sidewalls 22 onto itself when the bottle 16 is inverted, as shown by the arrows in FIG. 2. After the bottle has been inverted and the material 12 falls, it will be subjected to enough shear stress to overcome its thixotropic yield point. Once the yield point is broken the material 12 will express liquid properties making it easier to shake. This feature is unique to the present invention in contrast to conventional bottles, such as shown in FIG. 3, which are prone to resistive friction on the walls when shaken.

The foregoing detailed description is given for clearness of understanding only, and no unnecessary limitations should be understood therefrom, as modifications will be obvious to those skilled in the art.

I claim:

1. A receptacle for retaining a material, comprising:

a bottle having a base for placement of the bottle on a support surface, and sidewalls defining a chamber increasing in inner dimensions from the base toward an upper location of the bottle, with the portion of said sidewalls of increasing dimension including at least half of the total size of the chamber; and a thixotropic material received in said chamber.

2. The receptacle of claim 1 wherein the sidewalls are tapered outwardly toward said upper location of the bottle.

3. The receptacle of claim 2 wherein the thixotropic material fills said chamber to said upper location of the bottle.

4. The receptacle of claim 2 wherein the sidewalls are tapered inwardly from said upper location to an upper end of the bottle.

5. The receptacle of claim 1 wherein the sidewalls define an upper portion of the chamber decreasing in dimensions from said upper location to a top of said bottle.

6. A receptacle for retaining a material, comprising:

a bottle having a base for placement of the bottle on a support surface, and sidewalls defining a chamber increasing in inner dimensions from the base toward an upper location of the bottle, with the portion of said sidewalls of increasing dimensions being generally straight and steeply sloped toward the upper location of the bottle; and a thixotropic material received in said chamber.

7. A receptacle for retaining a material, comprising:

a bottle having a base for placement of the bottle on a support surface, and sidewalls defining a chamber increasing in inner dimensions from the base toward an upper location of the bottle, with the portion of said sidewalls of increasing dimension being generally straight and disposed at an acute angle between said sidewalls and a planar surface on which the base is disposed; and a thixotropic material received in said chamber.

8. The receptacle of claim 7 in which the acute angle is approximately 65 degrees.

* * * * *